United States Patent [19]

Harase et al.

[11] 4,371,405

[45] Feb. 1, 1983

[54] PROCESS FOR PRODUCING GRAIN-ORIENTED SILICON STEEL STRIP

[75] Inventors: Jiro Harase; Kunihide Takashima, both of Munakatamachi; Shozaburo Nakashima, Kitakyushu, all of Japan

[73] Assignee: Nippon Steel Corporation, Tokyo, Japan

[21] Appl. No.: 178,633

[22] Filed: Aug. 15, 1980

[30] Foreign Application Priority Data

Aug. 22, 1979 [JP] Japan ..... 54-106797

[51] Int. Cl.[3] ..... H01F 1/04

[52] U.S. Cl. ..... 148/111; 148/110

[58] Field of Search ..... 148/110, 111, 112, 113

[56] References Cited

U.S. PATENT DOCUMENTS

| | | | |
|---|---|---|---|
| 3,575,739 | 4/1971 | Fiedler | 148/111 |
| 3,636,579 | 1/1972 | Sakakura et al. | 148/111 |
| 3,846,187 | 11/1974 | Sakakura et al. | 148/111 |
| 4,115,161 | 9/1978 | Datta | 148/111 |
| 4,116,729 | 9/1978 | Katoh et al. | 148/111 |
| 4,123,298 | 10/1978 | Kohler et al. | 148/111 |
| 4,231,818 | 11/1980 | Henke | 148/111 |

*Primary Examiner*—John P. Sheehan

*Attorney, Agent, or Firm*—Wenderoth, Lind & Ponack

[57] ABSTRACT

In a process for producing a grain-oriented silicon steel strip, comprising the steps of: hot rolling, annealing, if necessary; heavy cold rolling; decarburization-annealing, and; final annealing, an improvement which comprises controlling a coiling temperature after the finish rolling of the hot rolling step within a range of from 700° to 1000° C. As a result of the coiling temperature control, the annealing of the hot rolled strip can be simplified or omitted, while the behavior of a grain-growth inhibitor is equivalent to that in the conventional process including the annealing step. The magnetic flux density of the material produced by the process of the present invention is excellent, notwithstanding the simplification or omission of the annealing.

8 Claims, No Drawings

PROCESS FOR PRODUCING GRAIN-ORIENTED SILICON STEEL STRIP

The present invention relates to a process for producing a grain-oriented silicon steel strip or sheet, wherein the texture of the steel strip or sheet has a {110} <001> orientation which is easily magnetized in the rolling direction.

As is well known, in grain-oriented silicon steel strips or sheets, a grain-growth inhibitor, such as MnS, AlN or the like, plays an important role in obtaining excellent magnetic properties in the rolling direction due to secondary recrystallization. It is crucial, in the production of grain-oriented silicon steel strips or sheets with a high magnetic flux density, to effectively control the solid-solution and precipitation of the grain-growth inhibitor, hereinafter simply referred to as the inhibitor.

In order to perform such effective control, steel slabs have conventionally been heated to a high temperature, for example over 1300° C., prior to a hot rolling, so as to bring the constituents of the inhibitor satisfactorily into a solid solution. The slabs are then hot rolled in such a manner that the precipitation of AlN or the like is suppressed as effectively as possible and finally, the hot rolled strip is subjected to an annealing so as to precipitate AlN as disclosed, for example, in Japanese Published Patent Application No. 23820/1973 (U.S. Pat. No. 3,636,579).

A large amount of energy is required for the grain-oriented silicon steel production which is mainly comprised of the casting, hot rolling, annealing, cold rolling, decarburization and final annealing steps. Recently, the production steps requiring a large amount of energy have been examined from the point of view of coping with an increasing demand for reducing energy consumption and omitting or simplifying the production steps of the grain-oriented silicon steel strip or sheet. In order to cope with such demand, the present inventors conducted studies of the production processes of grain-oriented silicon steel strips or sheets. However, it was impossible to basically change the production processes, because an extremely strict control of the production is required, as is well known, for producing the grain-oriented silicon steel strips or sheets, especially those having a high magnetic flux density, and further, because the magnetic properties of the finished product are greatly influenced by even a subtle modification of each production step.

It is an object of the present invention to omit or simplify one of the production steps of a grain-oriented silicon steel strip or sheet, in such a manner that the behaviour of a grain-growth inhibitor, such as MnS, AlN or the like which is important for the production of the grain-oriented silicon steel strips or sheets, is controlled so that it is equivalent to that in the conventional process for producing such steel.

The present inventors studied the annealing step of the hot rolled strip and discovered that simplification and even omission of the annealing of the hot rolled strip can be accomplished by coiling the hot rolled strip at a high temperature.

A feature of the present invention is coiling a steel strip within a high temperature range of from 700° to 1000° C., preferably from 750° to 1000° C., after the completion of the hot rolling. When the hot rolled coil is maintained within the high temperature range over a period of from 10 minutes to 5 hours, the effects of the high temperature coiling are remarkably enhanced.

In the case where the annealing of the hot rolled strip is omitted, the coiling of the hot rolled strip is preferably followed by rapid cooling or quenching, for example, by immersion of the coil into a water bath. The reason the annealing step of the hot rolled strip can be omitted or simplified by the high temperature coiling subsequent to the hot rolling is not completely elucidated, but seems to the present inventors to reside in the following.

The presence of fine precipitates, such as AlN or the like, as an inhibitor prior to the secondary recrystallization annealing is crucial in the process for producing a grain-oriented silicon steel containing aluminum. Since, at the present time, a single-stage cold rolling is mainly adopted for the cold rolling step in the production process of a grain-oriented silicon steel strip or sheet having a high magnetic flux density, the hot rolled steel strip is heat treated so as to form AlN in the steel strip. The heat treatment conditions are, therefore, specified as: (1) precipitating AlN more than a predetermined amount; and, (2) generating fine AlN precipitated during cooling. These two factors lead to stabilizing the secondary recrystallization and, thus, controlling the crystal orientation as desired. In order to form in steel strips such ingredients having the inhibition effect as AlN or the like, the coiling after completion of the hot rolling is performed within the high temperature range of from 700° to 1000° C., preferably from 750° to 1000° C., in accordance with the present invention, and if necessary, maintenance within the temperature range and/or quenching from the temperature range are conducted, thereby making it possible to obtain a high magnetic flux density material which is processed without the hot rolled strip annealing step or with a simplified annealing step compared to that of the prior art. The high temperature coiling subsequent to the completion of hot rolling, the coiling preferably followed by the temperature maintenance, satisfactorily fulfills the condition (1) of the AlN precipitation amount and the condition (2) to a certain extent. Therefore, the secondary recrystallization completely develops even with the omission of the annealing of the hot rolled strip. When the coiling at a high temperature is followed by quenching, the condition (2) is fulfilled, and thus, magnetic properties are enhanced by the quenching. In the annealing of the hot rolled strip, which may be carried out in the present invention, the annealing condition is such that only the condition (2) is achieved, because the hot rolled strip already fulfills the condition (1). In the case where the high temperature coiling and heat maintenance are followed by the annealing of the hot rolled strip, it is, therefore, possible to considerably shorten the annealing time and/or considerably reduce the annealing temperature as compared with the prior art. According to the present invention, the annealing temperature may be from 750° to 1150° C. and the heating time at this temperature may be less than 10 minutes.

The industrial advantage of the present invention is great because, by controlling the coiling temperature of the hot rolled strip within a high temperature range of from 700° to 1000° C., a grain-oriented silicon steel strip or sheet having good magnetic properties, such as a high magnetic flux density, can be produced by a process in which the annealing step of the hot rolled strip is omitted or carried out at a considerably lower temperature over a shorter period of time.

The process of present invention is explained hereinafter more in detail.

The chemical composition of the starting material of the present invention must satisfy the following conditions, because a grain-oriented silicon steel strip or sheet with a high magnetic flux density is to be produced from the starting material.

| | |
|---|---|
| C: | from 0.030 to 0.085% |
| Si: | from 2.5 to 4% |
| Mn: | from 0.05 to 0.20% |
| S: | from 0.005 to 0.040% |
| An acid soluble Al: | from 0.010 to 0.065% |
| N: | from 0.0030 to 0.012% |

When the carbon content is less than 0.030%, structure coarsening occurs after the high temperature coiling and so called streaks are generated in the final product, which is not desirable. When the carbon content is more than 0.085%, the decarburization annealing time is undesirably long from an industrial point of view. A preferable carbon content is from 0.04 to 0.06%.

When the silicon content is less than 2.5%, the magnetic properties, especially the watt loss, are deteriorated, while at a silicon content of more than 4%, the cold rolling becomes difficult.

The manganese and sulfur form an inhibitor which surpresses primary grain growth, namely the normal grain growth of primary recrystallization grains. When the manganese and sulfur contents fall outside the ranges of from 0.05 to 0.20% and from 0.005 to 0.040%, respectively, the magnetic properties of the final product are deteriorated or the secondary recrystallization does not occur, which is not desirable.

The acid soluble aluminum is the basic element for obtaining a high magnetic flux density material. At an acid soluble aluminum content falling outside the range of from 0.010 to 0.065%, a high magnetic flux density cannot be obtained. A preferable content of the acid soluble aluminum is from 0.015 to 0.045%.

When the nitrogen content is less than 0.0030%, the precipitation quantity of the AlN, which is the inhibitor, is small. On the other hand, when the nitrogen content is more than 0.012%, blisters are undesirably formed in the final product.

A melt, which is adjusted to the composition range mentioned above by a known steel-making or melting process, is cast into ingots or a strand by known processes, and the thus obtained silicon-steel starting material is subjected, if necessary, to a hot rough rolling by slabbing or the like, so as to obtain slabs. The as-cast strand or the slabs roughly rolled are subsequently heated to a high temperature, for example, over 1300° C., and then, hot rolled into a hot rolled coil. In this hot rolling, the stages from the beginning to the finish rolling are performed by the technique which is known from Japanese Published Patent Application No. 2290/1976 (U.S. Pat. No. 3,846,187), however, the coiling stage and the processing stage after the coiling are performed as described hereinabove.

The coiling temperature must be controlled so that it is within a very high temperature range, i.e. from 700° to 1000° C., preferably from 750° to 1000° C., for the following reasons. When the coiling temperature is less than 700° C., a long maintenance time at the high temperature level is required for ensuring the precipitation quantity of AlN, with the result that decarburization of the hot rolled strip due to a mill scale proceeds and, thus, destroys the structure of the hot rolled strip, which makes it impossible to obtain a good final product. On the other hand, when the coiling temperature exceeds 1000° C., the middle portion of the coil is exposed to a high temperature over a long period of time after the coiling, which also leads to the destruction of the structure of the hot rolled strip. As a result, streaks tend to be undesirably formed in the final product. The coiling temperature in the range of from 750° to 1000° C. is preferable, because it is easy to ensure the precipitation amount of AlN, and further, it is possible to uniformly obtain a high magnetic flux density.

The method of high temperature coiling is not restricted to a specific method, but may be any method capable of being controlled within the high temperature range, such as a controlled cooling, non-forced air cooling, and an adjacent coiler. The controlled cooling can be carried out by controlling the quenching spray of the hot rolled strip or locating a cover above the runout table. When the amount of quenching spray water is reduced to zero, the hot rolled strip is allowed to cool in still air, i.e. by a non-forced air cooling. When the coiler of a hot strip mill is located following the finishing stand of the mill one third or one fourth close than in the conventional mill, the desired coiling temperature is obtained due to the adjacent coiler mentioned above. The steel strip coiled at a high temperature range is preferably maintained at such temperature range over a period of from 10 minutes to 5 hours by means of a holding furnace or a heat-insulative cover, so as to further promote the effects of high temperature coiling. The coiled strip is cooled to room temperature after the coiling by a method which is not limited to a specific one but the strip may be immersed into a water bath or the like.

The hot rolled strip as produced by the process described hereinabove is cold-rolled at a high reduction of more than 80% by a known process into the final gauge. However, annealing of the hot rolled strip for precipitating AlN may be carried out prior to the cold rolling by a known process, for example, as described in the U.S. Pat. No. 3,636,579. The high temperature coiled strip according to the present invention can bring about excellent results by being annealed at a temperature of not less than 700° C. over a short period of not more than 30 seconds. Obviously, at a long annealing period of from 30 seconds to 30 minutes, excellent results can also be obtained.

The coil, which has been cold-reduced to the final gauge, is then decarburization-annealed, coated with a annealing separator, such as MgO, and finally, annealed in a conventional manner, so as to obtain the final product.

The present invention will hereinafter be explained by way of examples.

EXAMPLE 1

200 mm thick silicon-steel slabs containing 0.06% of carbon, 3.0% of silicon, 0.08% of manganese, 0.025% of sulfur, 0.035% of the acid-soluble aluminum (solAl) and 0.008% of nitrogen were subjected to slab heating at 1400° C. and, immediately after the slab heating, a continuous hot rolling consisting of rough rolling and finish rolling was conducted so as to hot reduce the thickness of the slabs to 2.5 mm. After the hot rolling, the cooling water of the hot rolled strips was controlled in such a manner that the hot rolled strips were coiled in a temperature range of from 550° to 1000° C. After the coiling, the coil was allowed to cool in the coiled state in still air. The hot rolled strips, which had not been annealed, were pickled, cold rolled to 0.35 mm, decarburized within a wet hydrogen and nitrogen atmosphere and, subsequently, coated with MgO. The final annealing was then carried out at 1200° C. for 20 hours.

The relationship between the coiling temperature and the properties of the final products is indicated in the following Table 1.

TABLE 1

| Coiling Temperature | Secondary Recrystallization Ratio | Magnetic Flux Density ($B_{10}$) |
|---|---|---|
| 550° C. | 0% | 1.47 Tesla |
| 650° C. | 20% | 1.60 Tesla |
| 700° C. | 100% | 1.88 Tesla |
| 800° C. | 100% | 1.90 Tesla |
| 900° C. | 100% | 1.91 Tesla |
| 1000° C. | 100% | 1.88 Tesla |

It will be apparent from Table 1 that within the coiling temperature range of from 700° to 1000° C. the secondary recrystallization is completed, and further, a high magnetic flux density material having a $B_{10}$ value of 1.88 Tesla or higher is obtained.

EXAMPLE 2

Silicon steel slabs containing 0.05% of carbon, 2.9% of silicon, 0.07% manganese, 0.025% of sulfur, 0.025% of solAl and 0.008% of N nitrogen were hot rolled by the same method as in Example 1, and coiled at 550° C. and 850° C. The hot rolled strips were subsequently soaked at 1100° C. over a period of from 0 to 120 sec, followed by quenching into water of 100° C. This was then followed by the same cold rolling, decarburization annealing and final annealing as in Example 1. The magnetic flux density $B_{10}$ in Tesla of the obtained final products is indicated in the following Table 2.

TABLE 2

| Soaking Time | Coiling Temperature 550° C. | Coiling Temperature 850° C. |
|---|---|---|
| 0" | 1.855 | 1.930 |
| 30" | 1.890 | 1.953 |
| 60" | 1.932 | 1.948 |
| 120" | 1.953 | 1.960 |

It will be apparent from Table 2 that the coiled material at 850° C. displays excellent magnetic flux density even at a soaking time of less than 30 seconds.

EXAMPLE 3

The hot rolled strips of Example 2, which had been coiled at 850° C., were soaked at temperatures from 700° to 1100° C. over a period of 60 seconds and, then, quenched in water of 100° C. This was followed by the same cold rolling, decarburization-annealing and final annealing as in Example 1. The magnetic flux density $B_{10}$ in Tesla of the obtained final products is indicated in the following Table 3.

TABLE 3

| Soaking Temperature | $B_{10}$ (Tesla) |
|---|---|
| 700° C. | 1.910 |
| 800° C. | 1.930 |
| 900° C. | 1.928 |
| 1000° C. | 1.941 |
| 1100° C. | 1.948 |

It will be apparent from Table 3 that an excellent magnetic flux density is obtained by an annealing at 700° C.

EXAMPLE 4

The silicon steel slabs of Example 1 were hot rolled in the same manner as in Example 1, coiled at 750° C. and immediately after the coiling, the coils were maintained within a thermal insulating cover over a period of from 10 minutes to 10 hours, so as to thermally insulate the coils from the ambient air. Then, one of the coils was allowed to cool in the atmosphere and the other coil was immersed into a water bath. The hot rolled strips were subjected, after pickling, to the same cold rolling, decarburization-annealing and final annealing as in Example 1.

The magnetic flux density $B_{10}$ in Tesla of the final products is indicated in the following Table 4.

TABLE 4

| Maintaining Time | Cooling Method: Allowed to cool in atmosphere | Cooling Method: Immersion into Water Bath |
|---|---|---|
| Zero | 1.88 | 1.91 |
| 10 minutes | 1.90 | 1.92 |
| 1 hour | 1.92 | 1.94 |
| 5 hours | 1.90 | 1.93 |
| 10 hours | 1.82 | 1.87 |

We claim:

1. A process for producing a grain-oriented silicon steel strip or sheet with a high magnetic flux density said process employing AlN as a grain-growth inhibitor to achieve secondary recrystallization, said process comprising the steps of:

forming a silicon steel slab containing from 0.030 to 0.085% by weight of carbon, from 2.5 to 4% by weight of silicon, from 0.010 to 0.065% by weight of an acid-soluble aluminum, from 0.0030 to 0.012% by weight of nitrogen, from 0.05 to 0.20% by weight of manganese, and from 0.005 to 0.040% by weight of sulfur, the balance being iron and unavoidable impurities;

hot rolling the silicon steel slab and coiling the resulting hot rolled strip at a temperature controlled within a range of from 700° to 1000° C.;

heavily cold rolling the hot rolled strip in one step to reduce the thickness of the strip an amount of not less than 80% so that it reaches the final gauge;

decarburization-annealing the strip, and coating the strip with a separating agent, and finally, finish-annealing the strip.

2. A process according to claim 1, wherein the coiling temperature is controlled so as to be within a temperature range of from 750° to 1000° C.

3. A process according to claim 2, wherein the hot rolled strip coiled within said temperature range is maintained, after the coiling, within said temperature range over a period of from 10 minutes to 5 hours.

4. A process according to claim 1, further comprising a step of:

prior to said cold rolling step, annealing and then quenching the hot rolled strip.

5. A process according to claim 4, wherein the annealing temperature of said annealing is not more than 1150° C.

6. A process according to claim 4, wherein the annealing time is not longer than 10 minutes.

7. A process according to claim 2 or 3, wherein the hot rolled strip coil is quenched after coiling within said temperature range.

8. A process according to claim 7, wherein the hot rolled strip coil is directly subjected to the heavy cold rolling.

* * * * *